US009506359B2

(12) United States Patent
Kim et al.

(10) Patent No.: US 9,506,359 B2
(45) Date of Patent: Nov. 29, 2016

(54) TRANSITION NOZZLE COMBUSTION SYSTEM

(75) Inventors: Won-Wook Kim, Simponsville, SC (US); Kevin Weston McMahan, Greer, SC (US); Jaime Javier Maldonado, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1133 days.

(21) Appl. No.: 13/437,953

(22) Filed: Apr. 3, 2012

(65) Prior Publication Data

US 2013/0255266 A1 Oct. 3, 2013

(51) Int. Cl.
*F01D 9/02* (2006.01)

(52) U.S. Cl.
CPC ..... *F01D 9/023* (2013.01)

(58) Field of Classification Search
CPC ..... F01D 9/023; F23R 2900/03044; F23R 3/002; F23R 3/06; F23R 2900/03043; F23M 5/085
See application file for complete search history.

(56) References Cited

U.S. PATENT DOCUMENTS

| | | | | |
|---|---|---|---|---|
| D972,642 | | 10/1910 | Reed | |
| 2,851,853 | A | 9/1958 | Quick | |
| 2,945,672 | A | 7/1960 | Wagner et al. | |
| 3,238,718 | A | 3/1966 | Hill | |
| 3,657,884 | A | 4/1972 | Hugoson | |
| 4,016,718 | A | 4/1977 | Lauck | |
| 4,719,748 | A * | 1/1988 | Davis, Jr. | F01D 5/187 60/39.37 |
| H1008 | H | 1/1992 | Schadow et al. | |
| 5,125,796 | A | 6/1992 | Cromer | |
| 5,414,999 | A | 5/1995 | Barnes | |
| 5,706,646 | A | 1/1998 | Wilde et al. | |
| 5,761,898 | A | 6/1998 | Barnes et al. | |
| 6,412,268 | B1 * | 7/2002 | Cromer | F01D 9/023 60/760 |
| 6,546,627 | B1 * | 4/2003 | Sekihara et al. | 29/889.1 |
| 6,547,257 | B2 | 4/2003 | Cromer | |
| 6,684,620 | B2 | 2/2004 | Tiemann | |
| 6,720,088 | B2 * | 4/2004 | Zhao | B32B 15/01 148/408 |

(Continued)

FOREIGN PATENT DOCUMENTS

| | | |
|---|---|---|
| CN | 86105250 A | 2/1988 |
| CN | 1497217 A | 5/2004 |

(Continued)

OTHER PUBLICATIONS

U.S. Appl. No. 12/768,385, filed Apr. 27, 2010, David R. Johns, et al., Application no yet published.

(Continued)

*Primary Examiner* — Phutthiwat Wongwian
*Assistant Examiner* — Stefan Ibroni
(74) *Attorney, Agent, or Firm* — Sutherland Asbill & Brennan LLP

(57) ABSTRACT

The present application provides a combustion system for use with a cooling flow. The combustion system may include a head end, an aft end, a transition nozzle extending from the head end to the aft end, and an impingement sleeve surrounding the transition nozzle. The impingement sleeve may define a first cavity in communication with the head end for a first portion of the cooling flow and a second cavity in communication with the aft end for a second portion of the cooling flow. The transition nozzle may include a number of cooling holes thereon in communication with the second portion of the cooling flow.

16 Claims, 2 Drawing Sheets

(56) References Cited

U.S. PATENT DOCUMENTS

| | | | | |
|---|---|---|---|---|
| 6,840,048 | B2 | 1/2005 | Han et al. | |
| 7,310,938 | B2 * | 12/2007 | Marcum | F01D 9/023 60/39.37 |
| 7,363,763 | B2 * | 4/2008 | Coughlan et al. | 60/752 |
| 7,373,772 | B2 | 5/2008 | Simons et al. | |
| 7,493,767 | B2 | 2/2009 | Bunker et al. | |
| 7,584,620 | B2 | 9/2009 | Weaver et al. | |
| 7,721,547 | B2 | 5/2010 | Bancalari et al. | |
| 2006/0130484 | A1 * | 6/2006 | Marcum | F01D 9/023 60/752 |
| 2009/0214333 | A1 | 8/2009 | Hernandez et al. | |
| 2009/0252593 | A1 * | 10/2009 | Chila | F01D 9/023 415/58.4 |
| 2009/0266047 | A1 | 10/2009 | Kenyon et al. | |
| 2010/0037618 | A1 | 2/2010 | Charron et al. | |
| 2010/0115953 | A1 * | 5/2010 | Davis, Jr. | F01D 9/023 60/737 |
| 2010/0170257 | A1 | 7/2010 | Chila et al. | |
| 2010/0205972 | A1 | 8/2010 | Chila et al. | |
| 2010/0212325 | A1 | 8/2010 | Condevaux et al. | |
| 2010/0218502 | A1 | 9/2010 | Chila et al. | |
| 2010/0223930 | A1 | 9/2010 | Chila | |
| 2010/0242487 | A1 * | 9/2010 | Davis et al. | 60/772 |
| 2010/0257863 | A1 | 10/2010 | Chila et al. | |
| 2011/0247341 | A1 | 10/2011 | McMahan et al. | |
| 2012/0006028 | A1 * | 1/2012 | Lee | F01D 9/023 60/725 |
| 2012/0034075 | A1 * | 2/2012 | Hsu | F01D 9/023 415/178 |
| 2012/0121408 | A1 * | 5/2012 | Lee | F01D 9/023 415/214.1 |

FOREIGN PATENT DOCUMENTS

| | | | |
|---|---|---|---|
| CN | 101876452 | A | 11/2010 |
| JP | 4946663 | B1 | 12/1974 |
| JP | 2008544211 | A | 12/2008 |
| WO | 2008107401 | A1 | 9/2008 |

OTHER PUBLICATIONS

U.S. Appl. No. 12/768,385, filed Apr. 27, 2010, David Richard Johns.

US Non-Final Office Action issued in connection with related U.S. Appl. No. 12/768,385 on Jun. 27, 2013.

US Final Office Action issued in connection with related U.S. Appl. No. 12/768,385 on Oct. 24, 2013.

Unofficial English Translation of Chinese Office Action issued in connection with related CN Application No. 201110116512.0 on Jun. 3, 2014.

European Search Report and Opinion issued in connection with related EP Application No. 11163440.8 on Oct. 20, 2014.

Unofficial English Translation of Japanese Office Action issued in connection with related JP Application No. 2011089656 on Feb. 17, 2015.

Unofficial English Translation of Chinese Office Action issued in connection with corresponding CN Application No. 20130042475.2 on Nov. 25, 2015.

Unofficial English Translation of Japanese Office Action issued in connection with related JP Application No. 2011089656 on Dec. 1, 2015.

Unofficial English Translation of Chinese Office Action issued in connection with related CN Application No. 201110116512.0 on Jan. 27, 2016.

Chinese Patent Office Action for Application No. CN 201310042475.2 dated Jun. 15, 2016.

* cited by examiner

TRANSITION NOZZLE COMBUSTION SYSTEM

STATEMENT REGARDING FEDERALLY SPONSORED RESEARCH OR DEVELOPMENT

This invention was made with government support under Contract No. DE-FC26-05NT42643 awarded by the U.S. Department of Energy. The Government has certain rights in this invention.

TECHNICAL FIELD

The present application and the resultant patent relate generally to gas turbine engines and more particularly relate to a combustion system with a transition nozzle having minimized cooling pressure losses so as to increase firing temperatures and overall efficiency.

BACKGROUND OF THE INVENTION

In a transition nozzle combustion system (also known as a tangential combustor), the combustion system may be integrated with the first stage of the turbine. Specifically, the geometric configuration of the combustor may include a liner and a transition piece arranged to replace the functionality of the first stage nozzle vanes. The configuration thus may be used to accelerate and turn the flow of hot combustion gases from a longitudinal direction from the combustor to a circumferential direction for efficient use in the turbine. The efficiency of a transition nozzle combustion system thus generally focuses on limiting the pressure drop across the integrated liner, transition piece, and first stage nozzle vanes. Efficiency also may focus on limiting parasitic cooling and leakage flows—especially near the aft portion of the transition nozzle where the combustion gas flow may become choked. Specifically, the transition nozzle and the associated support structures may require a cooling system to withstand the aerodynamic heat loads associated with the high Mach Number combustion gas flows. Given such, a portion of the cooling flow may be used to cool the transition nozzle though film cooling. This portion of the flow, however, does not participate in charging the combustion flow and, hence, reduces overall system performance.

There is thus a desire for an improved transition nozzle combustion system. Preferable such a transition nozzle combustion system may provide adequate cooling of the components positioned about the hot combustion gas path while limiting the extent of the parasitic cooling and leakage flow loses for improved component lifetime and overall efficiency.

SUMMARY OF THE INVENTION

The present application and the resultant patent thus provide a combustion system for use with a cooling flow. The combustion system may include a head end, an aft end, a transition nozzle extending from the head end to the aft end, and an impingement sleeve surrounding the transition nozzle. The impingement sleeve may define a first cavity in communication with the head end for a first portion of the cooling flow and a second cavity in communication with the aft end for a second portion of the cooling flow. The transition nozzle may include a number of cooling holes thereon in communication with the second portion of the cooling flow.

The present application and the resultant patent further provide a transition nozzle combustion system for use with a cooling flow. The transition nozzle combustion system may include a transition nozzle extending from a head end to an aft end and an impingement sleeve surrounding the transition nozzle. The transition nozzle may include an integrated liner, transition piece, and first stage nozzle vane. The impingement sleeve may define a first cavity in communication with the head end for directing a first portion of the cooling flow and a second cavity in communication with the aft end for directing a second portion of the cooling flow.

The present application and the resultant patent further provide a transition nozzle combustion system for use with a cooling flow. The transition nozzle combustion system may include a transition nozzle extending from a head end to an aft end and an impingement sleeve surrounding the transition nozzle. The impingement sleeve may define a first cavity in communication with the head end for directing a first portion of the cooling flow and a second cavity in communication with the aft end for directing a second portion of the cooling flow. The impingement sleeve also may include a splitter rail dividing the first cavity and the second cavity. The transition nozzle may include a number of cooling holes thereon in communication with the second portion of the cooling flow.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
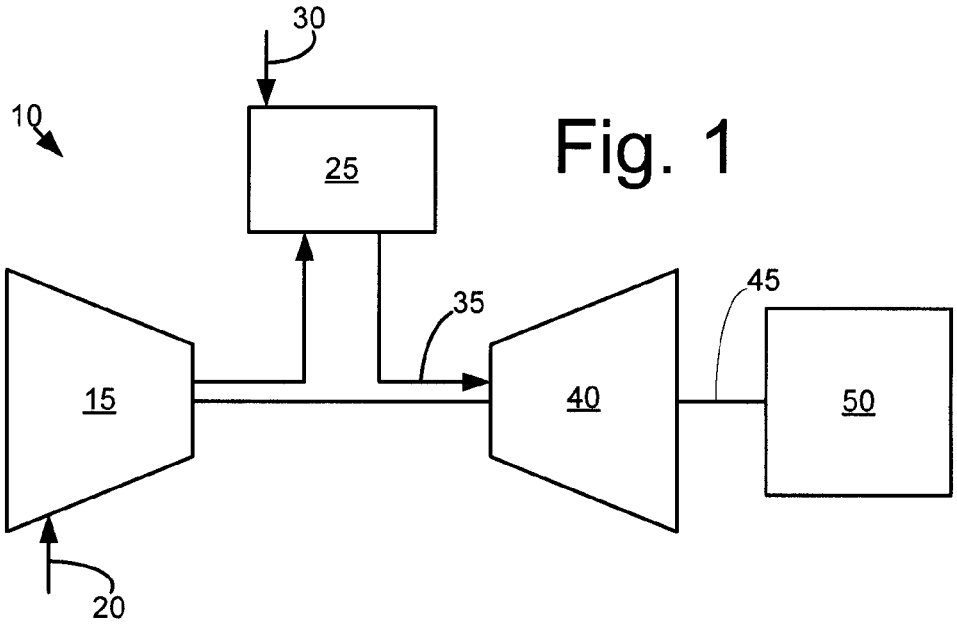
FIG. 1 is a schematic diagram of a gas turbine engine with a compression system, a combustion system, and a turbine.

Referring now to the drawings, in which like numerals refer to like elements throughout the several views, FIG. 1 shows a schematic view of gas turbine engine 10 as may be used herein. The gas turbine engine 10 may include a compression system 15. The compression system 15 compresses an incoming flow of air 20. The compression system 15 delivers the compressed flow of air 20 to a combustion system 25. The combustion system 25 mixes the compressed flow of air 20 with a pressurized flow of fuel 30 and ignites the mixture to create a flow of combustion gases 35. The flow of combustion gases 35 is in turn delivered to a turbine 40. The flow of combustion gases 35 drives the turbine 40 so as to produce mechanical work. The mechanical work produced in the turbine 40 drives the compression system 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y. and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
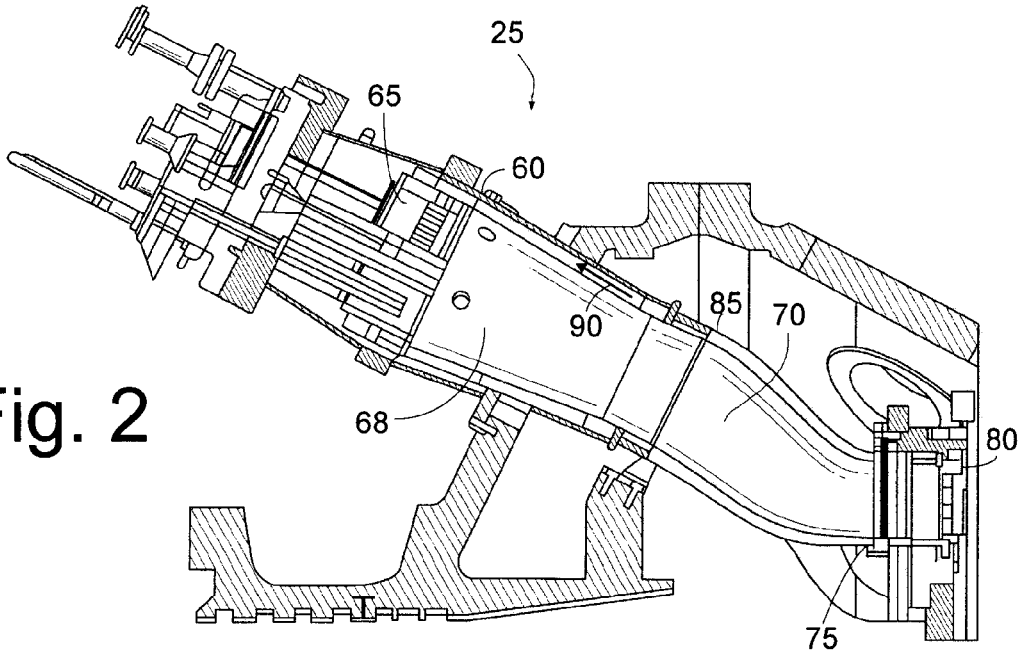
FIG. 2 is a schematic diagram of a combustion system that may be used with the gas turbine engine of FIG. 1.

FIG. 2 shows an example of the combustion system 25 that may be used in the gas turbine engine 10. A typical combustion system 25 may include a head end 60 with a number of fuel nozzles 65. A liner 68 and a transition piece 70 may extend downstream of the fuel nozzles 65 to an aft end 75 about a number of first stage nozzle vanes 80 of the turbine 40. An impingement sleeve 85 may surround the liner 68 and the transition piece 70 and provide a cooling flow thereto. Other types of combustors 25 and other types of components and other configurations are also known.

A cooling flow 90 from the compression system 15 or elsewhere may pass through the impingement sleeve 85. The cooling flow 90 may be used to cool the liner 68 and the transition piece 70 and then may be used at least in part in charging the flow of combustion gases 35. A portion of the flow 90 may head towards the aft end 75 and may be used for cooling the first stage nozzle vanes 80 and related components. Other types of cooling flows may be used. The loss of a portion of the cooling flow 90 thus results in a parasitic loss because that portion of the flow 90 is not used for charging the combustion flow 35.

Figure 3:
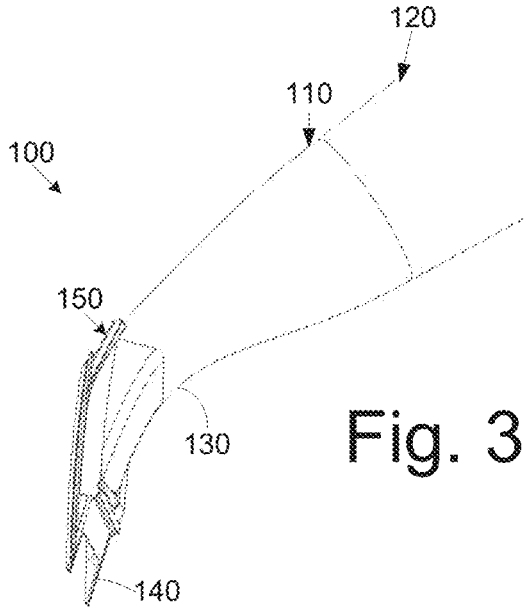
FIG. 3 is a partial perspective view of a transition nozzle combustion system as may be described herein.

FIG. 3 shows an example of a portion of a transition nozzle combustion system 100 as may be described herein. The transition nozzle combustion system 100 may include a transition nozzle 110. The transition nozzle 110 has an integrated configuration of a liner, a transition piece, and a first stage nozzle vane in a manner similar to that described above. The transition nozzle 110 extends from a head end 120 about the fuel nozzles 65 to a near choked flow region 130 and a transition nozzle aft end 140 about a number of bucket blades in a first turbine stage 150. The transition nozzle combustion system 100 thus may be considered an integrated combustion system. Other types of combustors in other configurations may be used herein.

Figure 4:
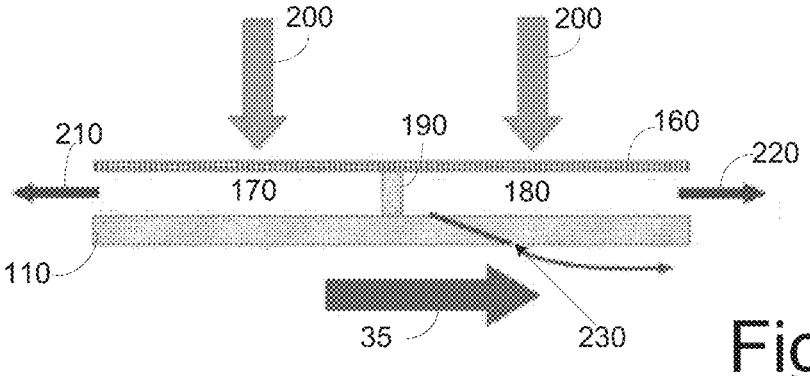
FIG. 4 is a schematic diagram of a portion of an impingement sleeve that may be used with the transition nozzle combustion system of FIG. 3.
Figure 5:
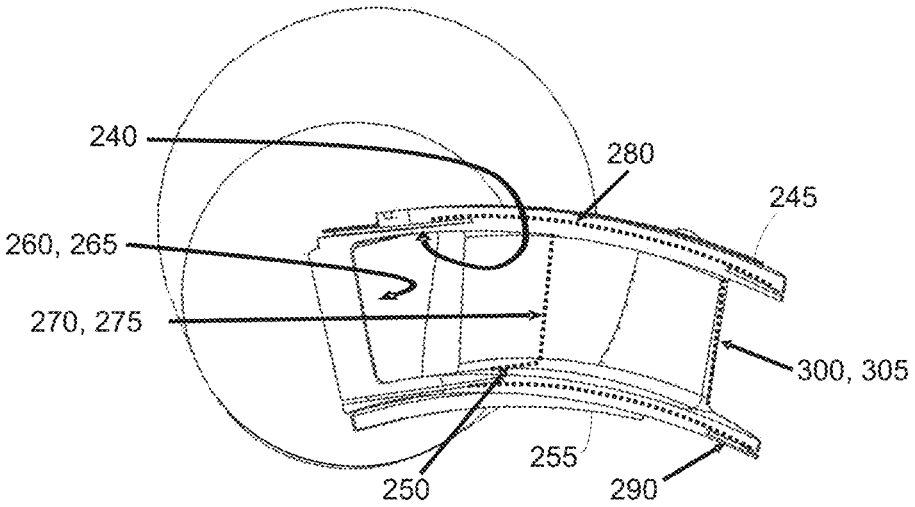
FIG. 5 is a partial sectional view of the transition nozzle combustion system of FIG. 3 from an aft end thereof.

FIG. 4 shows a portion of the transition nozzle 110 of the transition nozzle combustion system 100. Specifically, an impingement sleeve 160 may surround the transition nozzle 110 and may be in communication with the head end 120 and the aft end 140. The transition nozzle 110 and the impingement sleeve 160 may form a number of cavities therebetween: a first cavity 170 in communication with the head end 120 and a second cavity 180 in communication with the aft end 140. The cavities 170, 180 may be divided by a cavity splitter rail 190. A cooling flow 200 thus may be split into a first flow 210 in the first cavity 170 and a second flow 220 in the second cavity 180. The first flow 210 thus heads towards the head end 120 and may be used to charge the flow of combustion gases 35. The second flow 220 in the second cavity 180 heads towards the aft end 140. The second flow 220 may be used for film cooling or other types of cooling flows. The second flow 220 thus may be in communication with a number of cooling holes 230 positioned about the near choked flow region 130.

Specifically, the cooling holes 230 may include a number of outer sidewall film holes 240 on an outer sidewall 245 about the near choked flow region 130, a number of inner sidewalls film holes 250 on an inner sidewall 255 about the near choked flow region 130, a number of pressure side film holes 260 on a pressure side 265 about the near choked flow region 130, and a number of suction side film holes 270 on a suction side 275 about the near choked flow region 130. In addition, a number of outer sidewall aft cooling holes 280 may be positioned on the outer sidewall 245 and a number of inner sidewall aft cooling holes 290 may be positioned on the inner sidewall 255. Further, a number of trailing end cooling slots 300 may be used on a trailing edge 305. The second impingement cavity flow 220 may be in communication with the trailing end cooling slots 300. The size, shape, and configuration of the cooling holes 230 may vary. Not all of the cooling holes 230 need to be used. The cooling holes 230 may vary in size, shape, number, orientation, and position. The cooling holes 230 also may include diffusers at the exit surface to enhance file cooling performance. Other components and other configurations also may be used herein.

The use of the cooling holes 230 thus effectively cools the trailing end of the transition nozzle 110 where the combustion gases have the highest aerodynamic loads. Specifically, the arrangement of the cooling holes 230 serves to limit the film cooling requirements about the near choked flow region 130 of the transition nozzle 110. Reducing the cooling flow requirements thus reduces the pressure loss thereacross. Instead of being a parasitic loss, this saved cooling flow instead may be used to charge the flow of combustion gases 35 so as to increase the firing temperatures and, hence, increase overall combustor performance.

The transition nozzle combustion system 100 described herein may include thermal barrier coatings on the hot surfaces so as to reduce cooling requirements and further improve overall system and engine performance. Similarly, the components herein may be made from high performance materials such as ceramic metal composites and the like that may be capable of withstanding higher temperatures and reducing cooling requirements.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A combustion system for use with a cooling flow, comprising:

a head end;

an aft end;

a transition nozzle extending from the head end to the aft end;

an impingement sleeve surrounding the transition nozzle and defining a first cavity in communication with the head end for a first portion of the cooling flow and a second cavity in communication with the aft end for a second portion of the cooling flow, wherein the impingement sleeve comprises a splitter rail extending circumferentially between the transition nozzle and the impingement sleeve in a choked flow region of the transition nozzle, wherein the splitter rail divides and defines the first cavity and the second cavity as separate spaces, wherein the first portion of the cooling flow is provided to the head end through the first cavity and is used to charge a flow of combustion gases, wherein the second portion of the cooling flow is provided to the aft end through the second cavity and is used for film cooling, wherein the transition nozzle comprises an integrated liner, a transition piece, and a first stage nozzle vane; and a plurality of cooling holes positioned about the transition nozzle and in communication with the second portion of the cooling flow, wherein a main portion of the second portion of the cooling flow is directed to the aft end in the second cavity and a secondary portion of the second portion of the cooling flow is directed to the plurality of cooling holes along the second cavity for film cooling.

2. The combustion system of claim 1, wherein the transition nozzle comprises an outer sidewall with a plurality of outer sidewall film cooling holes thereon.

3. The combustion system of claim 1, wherein the transition nozzle comprises an inner sidewall with a plurality of inner sidewall film cooling holes thereon.

4. The combustion system of claim 1, wherein the transition nozzle comprises a pressure side with a plurality of pressure side film cooling holes thereon.

5. The combustion system of claim 1, wherein the transition nozzle comprises a suction side with a plurality of suction side film cooling holes thereon.

6. The combustion system of claim 1, wherein the transition nozzle comprises an outer sidewall with a plurality of outer sidewall aft cooling holes thereon.

7. The combustion system of claim 1, wherein the transition nozzle comprises an inner sidewall with a plurality of inner sidewall aft cooling holes thereon.

8. The combustion system of claim 1, wherein the transition nozzle comprises a trailing end with a plurality of trailing end cooling holes thereon.

9. The combustion system of claim 1, further comprising a plurality of fuel nozzles in communication with the first portion of the cooling flow.

10. The combustion system of claim 1, wherein the transition nozzle comprises a thermal barrier coating thereon.

11. The combustion system of claim 1, further comprising a combustor at the head end and a turbine at the aft end.

12. A transition nozzle combustion system for use with a cooling flow, comprising:

a transition nozzle extending from a head end to an aft end;

the transition nozzle comprising an integrated liner, transition piece, and first stage nozzle vane; and an impingement sleeve surrounding the transition nozzle;

the impingement sleeve defining a first cavity about a circumference of the transition nozzle and in communication with the head end for directing a first portion of the cooling flow and a second cavity about the circumference of the transition nozzle in communication with the aft end for directing a second portion of the cooling flow, wherein the impingement sleeve comprises a splitter rail extending circumferentially between the transition nozzle and the impingement sleeve in a choked flow region of the transition nozzle, wherein the splitter rail divides and defines the first cavity and the second cavity as separate spaces, wherein the first portion of the cooling flow is provided to the head end through the first cavity and is used to charge a flow of combustion gases, wherein the second portion of the cooling flow is provided to the aft end through the second cavity and is used for film cooling, wherein a main portion of the second portion of the cooling flow is directed to the aft end in the second cavity and a secondary portion of the second portion of the cooling flow is directed to a plurality of cooling holes along the second cavity for film cooling.

13. The transition nozzle combustion system of claim 12, wherein the transition nozzle comprises an outer sidewall with a plurality of outer sidewall film cooling holes thereon and an inner sidewall with a plurality of inner sidewall film cooling holes thereon.

14. The transition nozzle combustion system of claim 12, wherein the transition nozzle comprises a pressure side with a plurality of pressure side film cooling holes thereon and a suction side with a plurality of suction side film cooling holes thereon.

15. The transition nozzle combustion system of claim 12, wherein the transition nozzle comprises a trailing end with a plurality of trailing end cooling holes thereon.

16. A transition nozzle combustion system for use with a cooling flow, comprising:

a transition nozzle extending from a head end to an aft end wherein the transition nozzle comprises an integrated liner, a transition piece, and a first stage nozzle vane; and an impingement sleeve surrounding the transition nozzle;

the impingement sleeve defining a first cavity in communication with the head end for directing a first portion of the cooling flow and a second cavity in communication with the aft end for directing a second portion of the cooling flow;

wherein the impingement sleeve comprises a splitter rail extending circumferentially between the transition nozzle and the impingement sleeve in a choked flow region of the transition nozzle, wherein the splitter rail divides and defines the first cavity and the second cavity as separate spaces, wherein the first portion of the cooling flow is provided to the head end through the first cavity and is used to charge a flow of combustion gases, wherein the second portion of the cooling flow is provided to the aft end through the second cavity and is used for film cooling; and wherein the transition nozzle comprising a plurality of cooling holes thereon in communication with the second portion of the cooling flow, wherein a main portion of the second portion of the cooling flow is directed to the aft end in the second cavity and a secondary portion of the second portion of the cooling flow is directed to the plurality of cooling holes along the second cavity for film cooling.

* * * * *